US006281188B1

(12) United States Patent
Kandasamy et al.

(10) Patent No.: US 6,281,188 B1
(45) Date of Patent: Aug. 28, 2001

(54) PROCESS FOR MAKING A LOW DENSITY DETERGENT COMPOSITION

(75) Inventors: Manivanan Kandasamy; Yuji Nakamura, both of Hyogo (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/269,866

(22) PCT Filed: Oct. 4, 1996

(86) PCT No.: PCT/US96/15960

§ 371 Date: Apr. 1, 1999

§ 102(e) Date: Apr. 1, 1999

(87) PCT Pub. No.: WO98/14550

PCT Pub. Date: Apr. 9, 1998

(51) Int. Cl.[7] ..... C11D 11/00

(52) U.S. Cl. ..... 510/444; 510/451; 510/495; 264/117; 264/141

(58) Field of Search ..... 510/444, 451, 510/351, 495, 507, 509; 264/117, 141

(56) References Cited

U.S. PATENT DOCUMENTS

| | | | | |
|---|---|---|---|---|
| 5,108,646 | | 4/1992 | Beerse et al. | 252/174.25 |
| 5,366,652 | | 11/1994 | Capeci et al. | 252/89.1 |
| 5,451,354 | * | 9/1995 | Aouad et al. | 364/117 |
| 5,494,599 | * | 2/1996 | Goovaerts et al. | 510/444 |
| 5,576,285 | * | 11/1996 | France et al. | 510/444 |
| 5,616,550 | * | 4/1997 | Kruse et al. | 510/444 |

FOREIGN PATENT DOCUMENTS

| | | | | |
|---|---|---|---|---|
| 0508543 | * | 10/1992 | (EP) . | |
| WO 96/27655 | | 9/1996 | (WO) | C11D/17/06 |

* cited by examiner

*Primary Examiner*—Lorna M. Douyon
(74) *Attorney, Agent, or Firm*—Marianne Dressman; Kim William Zerby; Steven W. Miller

(57) ABSTRACT

A non-tower process for preparing a granular detergent composition having a low density of less than 600 g/l is provided. The process comprises the steps of: (a) mixing an anionic surfactant paste comprising from about 35% to about 85% anionic surfactant and from about 15% to about 65% water with a sufficient amount of a particulate water absorbing material to form a solid mass having a penetration value of from about 75 gf to about 4,000 gf, then (b) agglomerating the solid mass from step (a) and an amount of one or more other detergent ingredients in a mixer so as to produce agglomerates having an anionic surfactant content of from about 12% to about 60%.

7 Claims, No Drawings

PROCESS FOR MAKING A LOW DENSITY DETERGENT COMPOSITION

FIELD OF THE INVENTION

The present invention generally relates to a process for producing a low density detergent composition. More particularly, the invention is directed to a non-tower process during which low density detergent agglomerates are produced by hardening an aqueous surfactant paste by mixing said paste with a water absorbing material, and then mixing the hardened paste with other detergent ingredients so as to produce agglomerates. The process produces a free flowing, low density detergent composition which can be commercially sold as a conventional non-compact detergent composition or used as an admix in a low dosage, "compact" detergent product.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modern detergent products need to be "compact" in nature remains unsettled. In fact, many consumers, especially in developing countries, continue to prefer higher dosage levels in their respective laundering operations. One characteristic common to the existing process for producing modern detergent composition by agglomeration, namely, non-tower process, is that the apparent density of the granules by such process is typically not less than 600 g/l. Consequently, there is a need in the art of agglomeration (e.g., non-tower process) to produce modem detergent compositions for flexibility in the ultimate density of the final composition, especially for low density (for example, the range of the density is from about 300 g/l to about 600 g/l).

Generally, there are three primary types of processes by which detergent granules or powders can be prepared. The first type of process involves spray-drying an aqueous detergent slurry in a spray-drying tower to produce highly porous detergent granules (e.g., tower process for low density detergent compositions). The second type of process involves spray-drying an aqueous detergent slurry in a spray-drying tower as the first step, then, the resultant granules are agglomerated with a binder such as a nonionic or anionic surfactant, and finally, various detergent components are dry mixed to produce detergent granules (e.g., tower process plus agglomeration process for high density detergent compositions). In the third type of process, the various detergent components are dry mixed after which they are agglomerated with a binder such as a nonionic or anionic surfactant, to produce high density detergent compositions (e.g., agglomeration process for high density detergent compositions). In the above three processes, the important factors which govern the density of the resulting detergent granules are the shape, porosity and particle size distribution of said granules, the density of the various starting materials, the shape of the various starting materials, and their respective chemical composition.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been made to provide continuous processes for increasing the density of "post-tower" or spray dried detergent granules. Typically, such processes require a first apparatus which pulverizes or grinds the granules and a second apparatus which increases the density of the pulverized granules by agglomeration. While these processes achieve the desired increase in density by treating or densifying "post tower" or spray dried granules, they are limited in their ability to go higher in surfactant active level without subsequent coating step. In addition, treating or densifying by "post tower" is not favourable in terms of economics (high capital cost) and complexity of operation. Moreover, all of the aforementioned processes are directed primarily for densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of detergents in a more efficient manner. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which starting detergent materials in the form of pastes, liquids and dry materials can be effectively agglomerated into crisp, free flowing detergent agglomerates having low densities.

Accordingly, there remains a need in the art to have a non-tower process for producing a low density detergent composition directly from starting detergent ingredients. Also, there remains a need for such a process which is more efficient, flexible and economical to facilitate large-scale production of detergents of low as well as high dosage levels.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894.

The following references are directed to producing detergents by agglomeration: Charles et al, U.S. Pat. No. 4,992,079 (FMC Corporation), Beujean et al, Laid-open No. WO93/23,523 (Henkel), Beerse et al, U.S. Pat. No. 5,108,646 (Procter & Gamble); Capeci et al, U.S. Pat. No. 5,366,652 (Procter & Gamble); Aouad et al, U.S. Pat. No. 5,451,354 (Procter & Gamble); Hollingsworth et al, European Patent Application 351,937 (Unilever);and Swatling et al, U.S. Pat. No. 5,205,958.

The U.S. Pat. No. 4,992,079 describes agglomeration process for low density nonphosphate detergents having increased resistance to non ionic bleeding. The first process step agglomerates detergent ingredients with non aqueous liquid surfactant. The first step is, followed by a second agglomeration step where the surfactant loaded particles are dispersed into an inert gaseous medium, wetting the dispersed particles with atomized stream of aqueous sodium silicate or with separate atomized streams of water and concentrated sodium silicate to form the agglomerate detergent. It is not clear from the disclosure on what contributes to the low density. In addition, the disclosure does not include aqueous surfactants and phosphate containing detergents. The process in the U.S. Pat. No. 4,992,079 differs from the invention disclosed herein which will be apparent to those skilled in the art.

SUMMARY OF THE INVENTION

The present invention meets the aforementioned needs in the art by providing a non-tower process which produces a low density granular detergent composition directly from an anionic surfactant paste and other conventional detergent ingredients. The process of the proposed invention has capability of adjusting the density of the granules of the composition by controlled hardening of the anionic surfactant paste to a specified degree of hardness, as measured by penetration values. The process does not use the conventional spray drying towers currently which is limited in producing high surfactant loading compositions. In addition, the process of the present invention is more efficient, economical and flexible with regard to the variety of detergent compositions which can be produced in the process. Moreover, the process is more amenable to environmental concerns in that it does not use spray drying towers which typically emit particulates and volatile organic compounds into the atmosphere.

As used herein, the term "agglomerates" refers to particles formed by agglomerating raw materials with binder such as surfactants and or inorganic solutions l organic solvents and polymer solutions. All percentages used herein are expressed as "percent-by-weight" unless indicated otherwise.

In accordance with one aspect of the invention, a process for preparing a granular detergent composition having a low density (less than about 600 g/l), preferably from about 300 g/l to 600 g/l, is provided. The process comprises the steps of: (a) mixing an anionic surfactant paste comprising from about 35% to about 85% anionic surfactant and from about 15% to about 65% water with a sufficient amount of a particulate water absorbing material to form a solid mass having a penetration value of from about 75 gf to about 4,000 gf, then (b) agglomerating the solid mass from the step (a) and an amount of one or more other detergent ingredients in a mixer so as to produce agglomerates having an anionic surfactant content of from about 12% to about 60%.

Also provided are the granular detergent compositions having a low density of less than about 600 g/l, preferably from about 300 g/l to about 600 g/l, produced by any one of the process embodiments described herein.

Accordingly, it is an object of the invention to provide a process for continuously producing a low density detergent composition by controlling penetration value of anionic surfactant paste for agglomeration. It is also an object of the invention to provide a process which is more efficient, flexible and economical to facilitate large-scale production of detergents. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, granular detergent agglomerates having a low density of less than about 600 g/l, preferably from about 300 to about 600 g/l. The process produces low density detergent agglomerates from an anionic surfactant paste having a water content, of typically at least about 15%, generally from about 15 to about 65%, preferably from about 20 to about 60%, more preferably from about 30 to about 50%. The detergent agglomerates can be used as a detergent or as a detergent additive. It should be understood that the process described herein can be continuous depending upon the desired application.

Process

In the First Step of the process, an anionic surfactant paste (aqueous or non-aqueous), comprising from about 35% to about 85% anionic surfactant and from about 15% to about 65% water is mixed with sufficient amount of a particulate water absorbing material to form a solid mass having a penetration value of from about 75 gf to about 4,000 gf as measured according to a conventional penetrometer known to those skilled in the art (e.g., such as ASTM D 217-IP 50 or ISO 2137).

Forming a solid mass, as used herein, means not only making a mass of the anionic surfactant paste having a property of plastic solids or highly viscous fluids, but also means (i) increasing the anionic surfactant paste's apparent viscosity, (ii) increasing the anionic surfactant paste's effective melting point, (iii) increasing the "hardness" of the anionic surfactant paste. In the present invention, the hardness of the anionic surfactant paste after the first step is expressed as penetration value.

The mixing of the First Step can be accomplished in any type of equipment suitable for kneading plastic solids or highly viscous fluids. The penetration value which is given to the surfactant paste can be controlled by the equipment used for the mixing (e.g., the first step) and by the amount and the choice of water absorbing agent. A twin screw extruder such as that used as a plodder in the manufacture of soap bars is particularly suitable. Preferred examples of the twin screw extruder are: the CONTINUA-83, manufactured by Werner and Pfleiderer, and other twin screw extruders manufactured by such as Kurimoto Compounder or Reico Teledyne Compounder. The solid mass produced in the first step is sometimes referred to herein as "hardened paste".

In the Second Step of the process, the solid mass (hardened paste) obtained by the first step and other detergent ingredients are fed into a mixer which can be used for an agglomeration and is known to those skilled in the art for agglomeration, then the contents in the mixer are agglomerated so as to form detergent agglomerates having a density of less than about 600 g/l. As used herein, the phrase "other detergent ingredients" refers to ingredients selected from fine powders typically having an average diameter from 0.1 to 500 microns, preferably from about 1 to about 100 microns, or selected from the mixtures of the fine powders and optional ingredients selected from the group comprising such as (i) other surfactants, (ii) adjunct detergent ingredients and (iii) the mixtures thereof.

Generally speaking, to achieve the low density (less than about 600 g/l), preferably, the mean residence time in the mixer is from about 5 to about 30 seconds and tip speed for the mixer is in range from about 5 m/s to about 22 m/s, the energy per unit mass in the mixer is from about 0.15 kj/kg to about 12 kj/kg, more preferably, the mean residence time in the mixer is from about 5 to about 15 seconds and tip speed for the mixer is in range from about 6 m/s to about 20 m/s, the energy per unit mass for the mixer is from about 0.15 kj/kg to about 8 kj/kg, and most preferably, the mean residence time in the mixer is from about 5 to about 10 seconds and tip speed for the mixer is in range from about 6 m/s to about 18 m/s, the energy per unit mass for the mixer is from about 0.15 kj/kg to about 4.5 kj/kg.

The examples of mixers for the second step can be any types of mixer known to the skilled in the art, as long as the mixer can maintain the above mentioned condition for the second step. An Example can be Lödige CB Mixer manufactured by the Lödige company (Germany).

The detergent agglomerates produced by the process preferably have an anionic surfactant level of from about 12% to about 60%, more preferably from about 25% to about 55%, i.e. they comprise up to about 88% other detergent ingredients (including the ingredient used for paste hardening). The agglomerates are irregular in shape and have a relatively high degree of intraparticle voids, both of which characteristics contribute to low density. The present process typically provides detergent agglomerates having a mean particle size of from about 200 microns to about 800 microns, and more preferably from about 300 microns to about 650 microns. As used herein, the phrase "mean particle size" of agglomerates refers to average size of all particles that make up the agglomerate.

The agglomerates having desired mean particle size can be obtained by screening the agglomeration from the second step, since the agglomerates from the second step may contain a relatively large amount of fines that have to be recycled, further agglomeration (i.e., an additional mixing step) can be optionally used.

In this embodiment, after the solid mass and other detergent ingredients are fed into the first mixer and are agglomerated, the agglomerates and other liquid components (which are fully described in details hereinafter) can be added to the contents in one or more mixers (e.g., the second mixer, or the series of the second mixers) then the contents in this mixer are agglomerated so as to form detergent agglomerates having a density of less than about 600 g/l. The examples of mixers for the second mixer can be any types of mixer for agglomeration which are known to those skilled in the art. An example can be Lödige KM Mixer manufactured by the Lödige company (Germany) or Schugi Flexomic Model manufactured by the Schugi company (Netherlands).

In the case that the process includes the second mixer, it surprisingly reduces the amount of excess recycle fines from the second step, compared to the amount of excess recycle fines due to common agglomeration processes known to the skilled in the art. The existence of excess fines leads to excessive recycle streams which disrupt the process and are therefore not economically favourable.

Starting Detergent Materials

The total amount of the surfactants for the present invention, which are included in the following detergent surfactants, other liquid compositions and adjunct detergent ingredients is generally from about 5% to about 60%, more preferably from about 12% to about 55%, more preferably, from about 15% to about 45%, in total amount of the final product obtained by the process of the present invention. The surfactants which should be included in the above can be from any part of the process of the present invention., e.g., from either one of the first step or the second step, or both steps of the present invention.

Detergent Surfactants (a) Anionic Surfactant Paste

The amount of anionic surfactant in paste form can be from about 5% to about 60% (active), more preferably from about 12% to about 60% (active), more preferably, from about 25% to about 55% (active), in total amount of the final product obtained by the process of the present invention.

One or more various aqueous pastes of the salts of anionic surfactant is preferred for use in the present invention, including the water-soluble salts, preferably the alkali metal, ammonium and alkylolammonium salts of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.). Generally speaking, the water in the surfactant paste is as low as possible, while maintaining paste fluidity, since low moisture reads to a higher concentration of the surfactant in the finished agglomerates. In a preferred embodiment, the anionic surfactant paste comprises from about 35% to about 85% anionic surfactant, and from about 15% to about 65% water.

Nonlimiting examples of the preferred anionic surfactants useful in the present invention include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Useful anionic surfactants also include water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Optionally, other exemplary surfactants useful in the paste of the invention include $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and the corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Among the above non-limited examples, the preferable examples of anionic surfactant paste can be selected from the group consisting of alkyl benzene sulfonates, alkyl alkoxy sulfates, alkyl sulfates, coconut fatty alcohol sulfates and mixtures thereof.

(b) Secondary Surfactants

The secondary surfactant(s) which can be optionally applied for the second step of the present invention is/are preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,929,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred. The examples of the anionic surfactants described in the above (a) can also be used for the secondary surfactant.

Cationic surfactants can also be used as a detergent surfactant herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Ampholytic surfactants can also be used as a detergent surfactant herein, which include aliphatic derivatives of heterocyclic secondary and tertiary amines; zwitterionic surfactants which include derivatives of aliphatic quaternary ammonium, phosphonium and sulfonium compounds; water-soluble salts of esters of alpha-sulfonated fatty acids; alkyl ether sulfates; water-soluble salts of olefin sulfonates; beta-alkyloxy alkane sulfonates, betaines having the formula $R(R^1)_2N^+R^2COO^-$, wherein R is a $C_6$–$C_{18}$ hydrocarbyl group, preferably a $C_{10}$–$C_{16}$ alkyl group or $C_{10}$–$C_{16}$ acylamido alkyl group, each $R^1$ is typically $C_1$–$C_3$ alkyl, preferably methyl and $R_2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyidiethyl betaine; 4[$C_{14-16}$ acylmethylamidodiethylammonio]-1-carboxybutane; $C_{16-18}$ acylamidodimethylbetaine; $C_{12-16}$ acylamidopentanediethylbetaine; and [$C_{12-16}$ acylmethylamidodimethylbetaine. Preferred betaines are $C_{12-18}$ dimethyl-ammonio hexanoate and the $C_{10-18}$ acylamidopropane (or ethane) dimethyl (or diethyl) betaines; and the sultaines having the formula $(R(R^1)_2N^+R^2SO_3^-$wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12}$–$C_{14}$ amido propyl ammonio-2-hydroxypropyl sultaine, $C_{12}$–$C_{14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

Water Absorbinz Agent

The water absorbing agent mixed with the anionic surfactant paste in the first step of the process can be any granular material which is capable of absorbing water, modifying crystal structures of the selected anionic surfactant paste, providing elastic properties to the selected anionic surfactant paste, and which is suitable for use in detergent compositions.

One embodiment of preferred examples of suitable materials as water absorbing agent are hydrophilic precipitated silica, aluminosilicates which are fully described in the below section of "Fine Powders", and hydratable salts such as sodium carbonate, sodium sulfate, sodium citrate, trisodium phosphate, sodium tripolyphosphate (STPP), tetrasodium tripolyphosphate, soda ash, sodium carboxy methyl cellulose, and quaternary ammonium compounds.

Co-polymeric polycarboxylates such as a Acrylic/maleic-based copolymers may also be used as water absorbing agent of the present invention. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts.

The amount of water absorbing material used is that which is sufficient to produce a hardened paste which has a penetration value in the range of from about 100 to about 4,000 gf, preferably from about 1000 to about 3,000 gf. This amount, of course, will be dependent upon the water content of the paste and the water absorbing capacity of the water absorbent material. The amount of any particular water absorbing material required for any particular surfactant paste can be determined by routine experimentation.

Fine Powders

The amount of the fine powders of the present process, which is used in the second step, can be from about 94% to 30%, preferably from 86% to 54%, in total amount of starting material for the second step. The fine powders of the present process preferably selected from the group consisting of ground soda ash, powdered sodium tripolyphosphate (STPP), hydrated tripolyphosphate, ground sodium sulphates, aluminosilicates, crystalline layered silicates, nitrilotriacetates (NTA), phosphates, precipitated silicates, polymers, carbonates, citrates, powdered surfactants (such as powdered alkane sulfonic acids) and recycle fines occurring from the process of the present invention, wherein the average diameter of the powder is from 0.1 to 500 microns, preferably from 1 to 300 microns, more preferably from 5 to 100 microns. Consequently, the water absorbing agent for the first step of the present invention (which are described above) may suitable as fine powders for the second step of the present invention. In the case of using hydrated STPP as the fine powders of the present invention, STPP which is hydrated to a level of not less than 50% is preferable. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z\cdot(SiO_2)_y]\times H_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}\cdot(SiO_2)_{12}]\times H_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Other Liquid Components

The amount of the other liquid components (aqueous or non aqueous) which can be additionally used for the present process can be from less than about 10% (active basis), preferably from 2% to about 6% (active basis) in total amount of the final product obtained by the process of the present invention. The other liquid components of the present process can be selected from the group consisting of liquid silicate, liquid solutions of anionic or cationic surfactants, aqueous or non-aqueous polymer solutions, water and mixtures thereof. Other examples for the other liquid compositions of the present invention can be sodium carboxy methyl cellulose solution, polyethylene glycol (PEG), and solutions of dimethylene triamine pentamethyl phosphonic acid (DETMP), The preferable examples of the anionic surfactant solutions which can be used as the other liquid compositions in the present inventions are about 88–97% active HLAS, about 30–50% active NaLAS, about 28% active AE3S solution, about 40–50% active liquid silicate, and so on.

Liquid solution of cationic surfactants can also be used as other liquid compositions herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Preferable examples of the aqueous or non-aqueous polymer solutions which can be used as the other liquid components in the present inventions are modified polyamines which comprise a polyamine backbone corresponding to the formula:

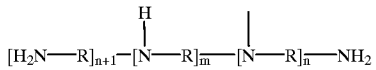

having a modified polyamine formula $V_{(n+1)}W_mY_nZ$ or a polyamine backbone corresponding to the formula:

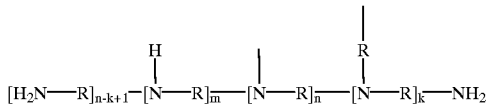

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the fonnula:

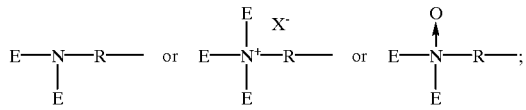

ii) W units are backbone units having the formula:

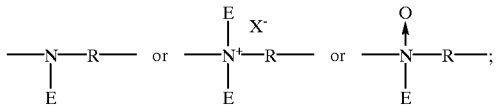

iii) Y units are branching units having the formula:

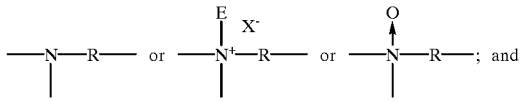

iv) Z units are terminal units having the formula:

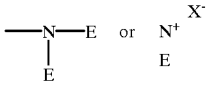

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$, —$(R^1O)_xR^5(OR^1)_x$—, $(CH_2)CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is $C_2$–$C_6$ alkylene and mixtures thereof; $R^2$ is hydrogen, —$(R^1O)_xB$, and mixtures thereof; $R^3$ is $C_1$–$C_{18}$ alkyl, $C_7$–$C_{12}$ arylalkyl, $C_7$–$C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —$C(O)NHR^6NHC(O)$—, —$R^1(OR^1)$—, —$C(O)(R^4)_rC(O)$—, —$CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; oxide; B is hydrogen, $C_1$–$C_6$ alkyl, —$(CH_2)_qSO_3M$, —$(CH_2)_pCO_2M$, —$(CH_2)_q$—$(CHSO_3M)CH_2SO_3M$, —$(CH_2)_q(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1. One example of the most preferred polyethyleneimines would be a polyethyleneimine having a molecular weight of 1800 which is further modified by ethoxylation to a degree of approximately 7 ethyleneoxy residues per nitrogen (PEI 1800, E7). It is preferable for the above polymer solution to be pre-complex with anionic surfactant such as NaLAS.

Other preferable examples of the aqueous or non-aqueous polymer solutions which can be used as the other liquid components in the present invention are polymeric polycarboxylate dispersants which can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Homo-polymeric polycarboxylates which have molecular weights above 4000, such as described next are preferred. Particularly suitable homo-polymeric polycarboxylates can be derived from acrylic acid. Such acrylic acid-based polymers which are useful herein are the water-soluble salts of polymerized acrylic acid. The average molecular weight of such polymers in the acid form preferably ranges from above 4,000 to 10,000, preferably from above 4,000 to 7,000, and most preferably from above 4,000 to 5,000. Water-soluble salts of such acrylic acid polymers can include, for example, the alkali metal, ammonium and substituted ammonium salts.

Co-polymeric polycarboxylates such as a Acrylic/maleic-based copolymers may also be used. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. It is preferable for the above polymer solution to be pre-complexed with anionic surfactant such as LAS.

Adjunct Detergent Ingredients

The present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}\cdot_yH_2O$$

wherein M is sodium or hydrogen, x is from about 1.9 to about 4 and y is from about 0 to about 20. More preferably, the crystalline layered sodium silicate has the formula $$NaMSi_2O_5 \cdot {}_yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Optional Process Steps

One optional step in the process is drying, if it is desired to reduce level of moisture in the agglomerates from the second step. This can be accomplished by a variety of apparatus, well known to these skilled in the art. Fluid bed apparatus is preferred, and will be referred to as the dryer in the discussion which follows.

In another optional step of the present process, the detergent agglomerates exiting the fluid bed dryer are further conditioned by additional cooling in cooling apparatus. The preferred apparatus for cooling is a fluid bed. Another optional process step involves adding a coating agent to improve flowability and/or minimize over-agglomeration of the detergent composition in one or more of the following locations of the instant process: (1) the coating agent can be added directly after the fluid bed cooler or dryer; (2) the coating agent may be added between the fluid bed dryer and the fluid bed cooler; (3) the coating agent may be added between the fluid bed dryer and a mixer for agglomeration (i.e., the first mixer or the second mixer in the second step) which is commonly known to those skilled in the art; and/or (4) the coating agent may be added directly to a mixer for agglomeration (i.e., the first mixer or the second mixer in the second step) which is commonly known to those skilled in the art and the fluid bed dryer. The coating agent is preferably selected from the group consisting of aluminosilicates, silicates, carbonates and mixtures thereof. The coating agent not only enhances the free flowability of the resulting detergent composition which is desirable by consumers in that it permits easy scooping for detergent during use, but also serves to control agglomeration by preventing or minimizing over-agglomeration, especially when added directly to the mixer for agglomeration. As those skilled in the art are well aware, over-agglomeration can lead to very undesirable flow properties and aesthetics of the final detergent product.

Optionally, the process can comprise the step of spraying an additional binder in the mixer(s) in the second step of the present invention or fluid bed dryers and/or fluid bed coolers. A binder is added for purposes of enhancing agglomeration by providing a "binding" or "sticking" agent for the detergent components. The binder is preferably selected from the group consisting of water, anionic surfactants, nonionic surfactants, liquid silicates, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized detergent agglomerates in a screening apparatus which can take a variety of forms including but not limited to conventional screens chosen for the desired particle size of the finished detergent product. Other optional steps include conditioning of the detergent agglomerates by subjecting the agglomerates to additional drying by way of apparatus discussed previously.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

The representative examples of the series of mixers to make granular detergent compositions according to the process of the present invention plus optional processes are as follows:

A. (a) Paste hardening by Twin Screw Extruder, then (b) agglomeration in (1) Lödige CB Model (the first mixer)—(2) Schugi Flexomic Model (the second mixer)—(3) sizing in a Mogensens sizer to remove particles over 4.5 mm—(4) drying in a Fluid Bed Dryer—(5) cooling in a Fluid Bed Cooler—(6) sizing in a Mogensen sizer to remove over 1.2 mm—(7) grinding to reduce over size agglomerates from the sizers—and (8) feeding ground agglomerates back to the fluid bed dryer or fluid bed cooler or Lodigie CB mixer;

B. (a) Paste hardening by Twin Screw Extruder, then (b) agglomeration in (1) Lödige CB Model (the first mixer)—(2) Schugi Flexomic Model (the first one of the "second mixer")—(3) Lödige KM Model (the second one of the "second mixer")—(4) sizing in a Mogensens sizer to remover particles over 4.5 mm—(5) drying in a Fluid Bed Dryer—(6)cooling in a Fluid Bed Cooler—(7) sizing in a Mogensen sizer to remover over 1.2 mm—(8) grinding to reduce over size agglomerates from the sizers—and (9) feeding ground agglomerates back to the fluid bed dryer or fluid bed cooler or Lodigie CB mixer.

C. (a) Paste hardening by Twin Screw Extruder, then (b) agglomeration in (1) Lödige CB Model (the first mixer)—(2) Lödige KM Model (the first one of the "second mixer")—(3) Schugi Flexomic Model (the second one of the "second mixer")—(4) sizing in a Mogensen sizer to remover particles over 4.5 mm—(5) drying in a Fluid Bed Dryer—(6) cooling in a Fluid Bed Cooler—(7) sizing in a Mogensen sizer to remover over 1.2 mm—(8) grinding to reduce over size agglomerates from the sizers—and (9) feeding ground agglomerates back to the fluid bed dryer or fluid bed cooler or Lodigie CB mixer.

The details of the agglomeration process for making low density detergent granules which can be preferred examples for the present invention is disclosed in co-application No. 09/269,813, Docket No. JA163F (filed Oct. 4, 1996) which was filed on the same day as the present invention now U.S. Pat. No. 6,156,719.

In order to make the present invention more readily understood, reference is made to the following examples, which are intended to be illustrative only and not intended to be limiting in scope.

EXAMPLES

The following example has been done by bench scale.

Example 1

The following is an example for obtaining agglomerates using Twin Screw Extruder (TSE) and Lödige CB mixer (CB-30) followed by fluid bed dryer (FBD), fluid bed cooler (FBC), and sizing.

The 251 g of aqueous coconut fatty alcohol sulfate surfactant paste (72% active) is mixed with 5 g hydrophilic silica in Twin Screw Extruder (S2 KRC Krimoto Kneader).

As the result, a solid mass of the hardened paste having penetration value about 75 g/f is obtained.

Then, The 200 g of the solid mass is added by the pin tools of a CB-30 mixer along with the 203 g of light granular STPP, the 224 g of ground soda ash (mean particle size of 10–20 microns), and the 250 g of recycle fines. The solid mass is fed at about 56° C., and the powders are fed at room temperature. The condition of the CB-30 mixer is as follows:

Residence time: 12 seconds

Tip speed: 8 to 10 m/s

Energy condition: 1.29 kj/kg

After the agglomeration, bed temperature of the FBD is maintained between 40–60° C. and bed temperature of the FBC is maintained between 15–30° C. Then, the resulting agglomerates are sized in a rotap to remove the particles which are over 1.18 mm or less than 150 $\mu$m.

The resulting granules have density of about 490 g/l.

Example 2

The following is an example for obtaining agglomerates using Twin Screw Extruder (TSE) and Lödige CB mixer (CB-30) followed by fluid bed dryer (FBD), fluid bed cooler (FBC), and sizing.

The 251 g of aqueous coconut fatty alcohol sulfate surfactant paste (72% active) is mixed with 10 g hydrophilic silica in Twin Screw Extruder (S2 KRC Kurimoto Kneader).

As the result, a solid mass of the hardened paste having a penetration value about 100 g/f is obtained.

Then, The 250 g of the solid mass is added by the pin tools of a CB-30 mixer along with the 203 g of light granular STPP , the 224 g of ground soda ash (mean particle size of 10–20 microns), and the 250 g of recycle fines. The solid mass is fed at about 48° C., and the powders were fed at room temperature. The condition of the CB-30 mixer is as follows:

Residence time: 12 seconds

Tip speed: 8 to 10 m/s

Energy condition: 1.78 kj/kg

After the agglomeration, bed temperature of the FBD is maintained between 40–60° C. and bed temperature of the FBC is maintained between 15–30° C. Then, the resulting agglomerates are sized in a rotap to remove the particles which are over 1.18 mm or less than 150 $\mu$m.

The resulting granules have density of about 450 g/l.

Having thus described the invention in detail, it will be obvious to those skilled in the art that various changes may be made without departing from the scope of the invention and the invention is not to be considered limited to what is described in the specification.

What is claimed is:

1. A non-tower process for manufacture of a granular detergent composition having a density of less than 600 g/l, comprising the steps of;

(a) mixing, in an extruder, an anionic surfactant paste comprising from about 35% by weight to about 85% by weight anionic surfactant and from about 15% by weight to about 65% by weight water with a sufficient amount of a particulate water absorbing material to form a solid mass having a penetration value of from about 75 gf to about 4,000 gf, wherein the particulate water absorbing material is selected from the group consisting of hydrophilic precipitated silica, aluminosilicates, sodium carbonate, sodium sulfate, sodium citrate, trisodium phosphate, sodium tripolyphosphate (STPP), tetrasodium tripolyphosphate, sodium carboxy methyl cellulose, quaternary ammonium compounds and mixtures thereof;

(b) agglomerating the solid mass from step (a) and an amount of one or more adjunct detergent ingredients in a mixer so as to produce agglomerates having an anionic surfactant content of from about 12% by weight to about 60% by weight.

2. The process according to claim 1, wherein the mixer of step (b) is operated under the following conditions to obtain the agglomerates, Mean Residence time: from about 5 to about 30 seconds, Tip Speed: from about 5 to about 22 m/s, Energy condition: from about 0.15 to about 12 kj/kg.

3. The process according to claim 1 wherein said adjunct detergent ingredients are fine powders having an average diameter from 0.1 to 500 microns.

4. The process according to claim 1 wherein said adjunct detergent ingredients are mixtures of fine powders and one or more ingredients selected from the group consisting of secondary surfactants, and liquid components.

5. The process according to claim 3 wherein the fine powders are selected from the group consisting of sodium sulphates, aluminosilicates, crystalline layered silicates, phosphates, precipitated silicates, polymers, carbonates, citrates, nitrilotriacetates (NTA), powdered surfactants, recycle fines from the step (b) and mixtures thereof.

6. The process according to claim 4 wherein the liquid components are selected from the group consisting of liquid silicates, solutions of anionic surfactants, solutions of cationic surfactants, aqueous polymer solutions, non-aqueous polymer solutions, water and mixtures thereof.

7. The process according to claim 1 wherein said anionic surfactant paste is selected from the group consisting of alkyl benzene sulfonates, alkyl alkoxy sulfates, alkyl sulfates, and mixtures thereof.

* * * * *